United States Patent [19]

Karkiewicz

[11] Patent Number: 4,610,371

[45] Date of Patent: Sep. 9, 1986

[54] TAMPER EVIDENT DISPENSING CLOSURE ASSEMBLY

[75] Inventor: Kenneth G. Karkiewicz, Berlin, N.J.

[73] Assignee: Dougherty Brothers Company, Buena, N.J.

[21] Appl. No.: 659,057

[22] Filed: Oct. 9, 1984

[51] Int. Cl.[4] ..... B65D 41/32

[52] U.S. Cl. ..... 220/266; 220/254; 222/153; 215/237; 206/807

[58] Field of Search ..... 220/266, 339, 307, 254; 222/153, 541; 206/807; 215/237

[56] References Cited

U.S. PATENT DOCUMENTS 4,361,250 11/1982 Foster ..... 220/266

4,463,869 8/1984 Lewis ..... 220/339

*Primary Examiner*—George T. Hall

*Attorney, Agent, or Firm*—Seidel, Gonda, Goldhammer & Abbott

[57] ABSTRACT

A closure assembly for a container has a dispensing opening which is selectably closed by a cover. To indicate that the container has been tampered with, the cover has a portion connected thereto by a weak zone which is severed as a result of moving the cover to an open position.

9 Claims, 9 Drawing Figures

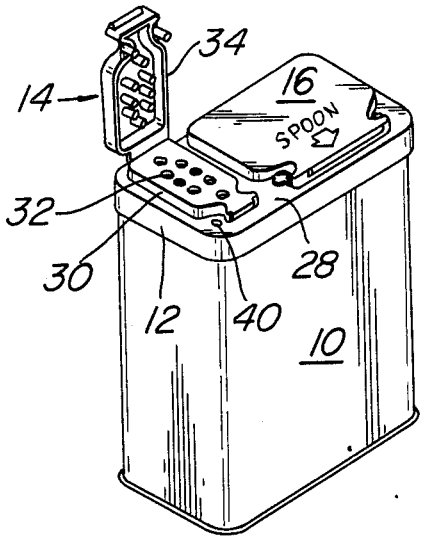
FIG. 1
FIG. 2
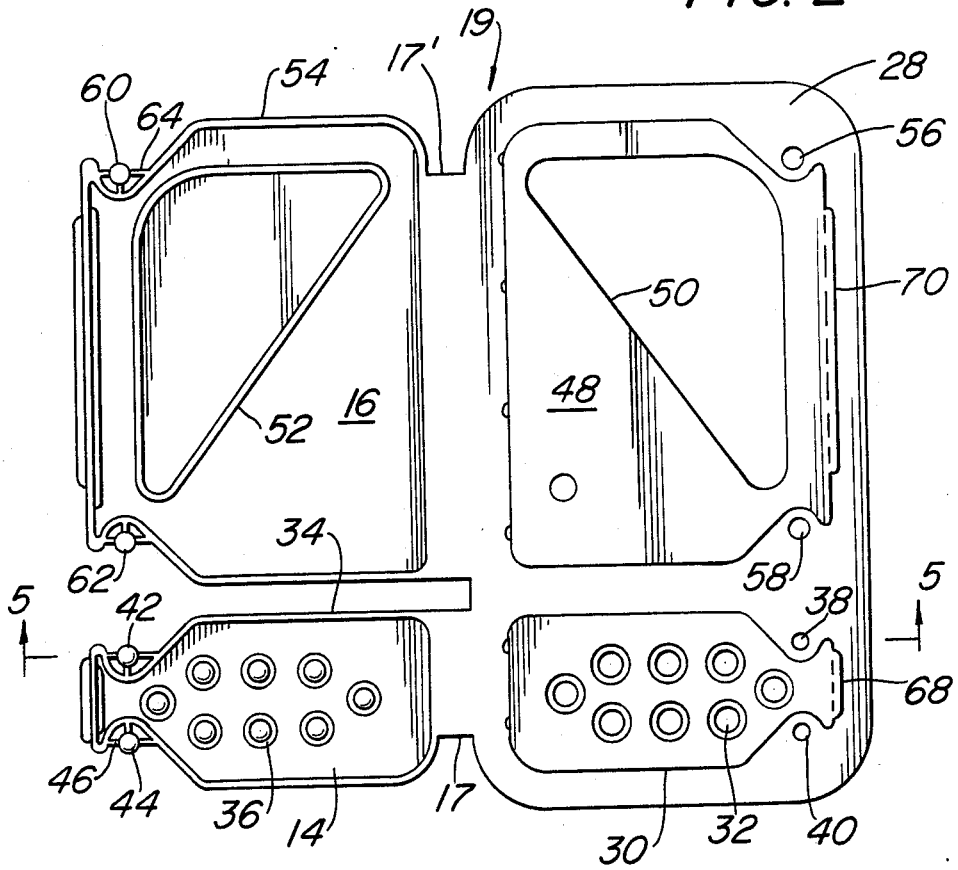

FIG. 3
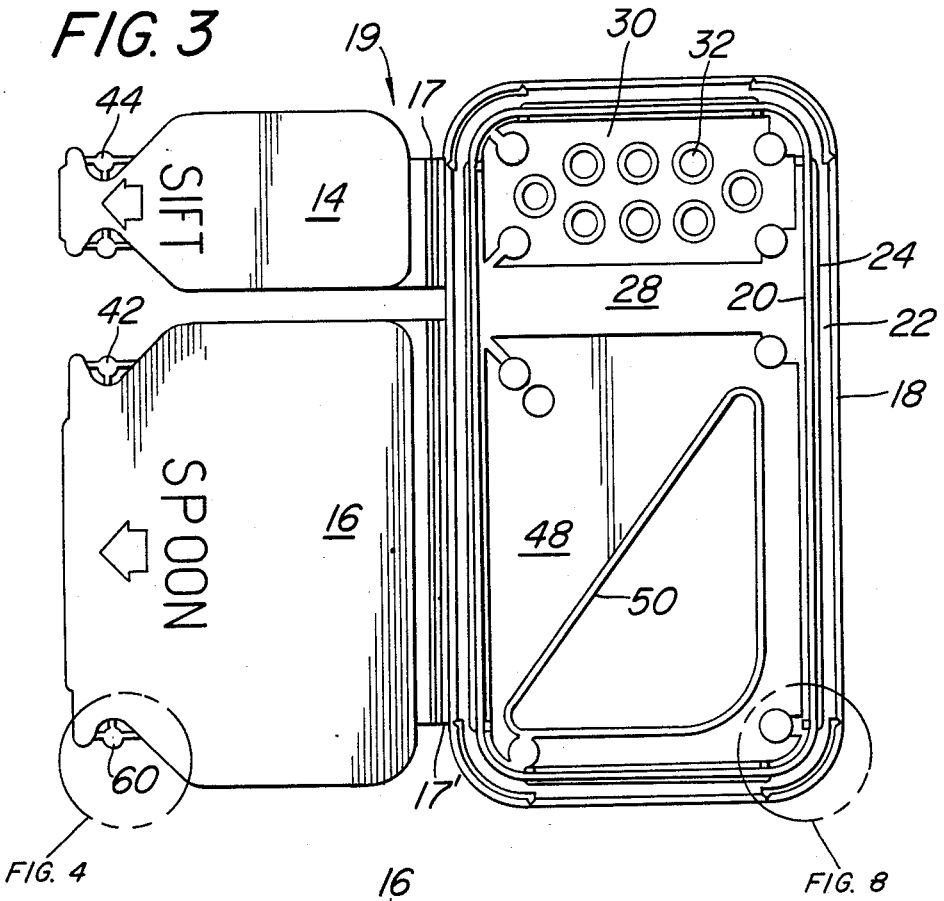
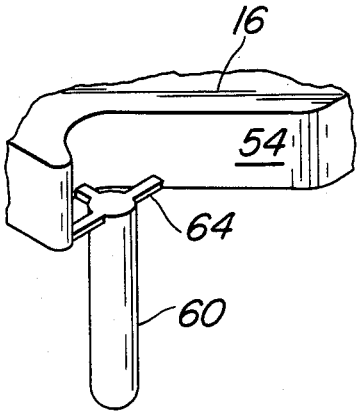
FIG. 4
FIG. 8
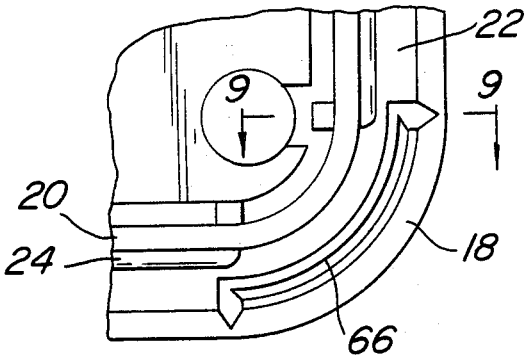

TAMPER EVIDENT DISPENSING CLOSURE ASSEMBLY

BACKGROUND

There is a need for a tamper evident dispensing closure assembly on a container to indicate that the container has been tampered with. The present invention is directed to a solution of the problem in a manner which is simple and inexpensive.

SUMMARY OF THE INVENTION

The present invention is directed to a tamper evident dispensing closure assembly. The assembly includes a closure having a periphery adapted for attachment to the open end of a container. The closure has a wall containing a dispensing opening. A cover is movably connected to the closure for movement between a closed position and an open position with respect to said opening. A means is provided on the assembly to indicate tampering. The tamper indicating means includes a first portion on the cover and a mating second portion on the closure. The first portion is connected to the cover by a weak zone which is severed as a result of moving the cover to its open position.

In an embodiment of the present invention, the closure assembly includes two covers which are each separately pivoted to the closure. A further tamper indicating means is provided on the closure to indicate that the closure has been removed from the container.

It is an object of the present invention to provide a novel tamper evident dispensing closure assembly which is simple, inexpensive, and which can be utilized on a wide variety of containers containing a wide variety of products.

Other objects and advantages of the present invention will be set forth hereinafter.

For the purpose of illustrating the invention, there is shown in the drawings a form which is presently preferred; it being understood, however, that this invention is not limited to the precise arrangements and instrumentalities shown.

FIG. 1 is a perspective view of a container and the closure assembly of the present invention.

FIG. 2 is a top plan view of the closure assembly with the covers in their open disposition.

FIG. 3 is a bottom plan view of the closure assembly with the covers in their open disposition.

FIG. 4 is a partial perspective view of the structure within the phantom circle in FIG. 3 but on an enlarged scale.

FIG. 8 is a enlarged detail view of the structure shown within the phantom circle in FIG. 3.

DETAILED DESCRIPTION

Figure 5:
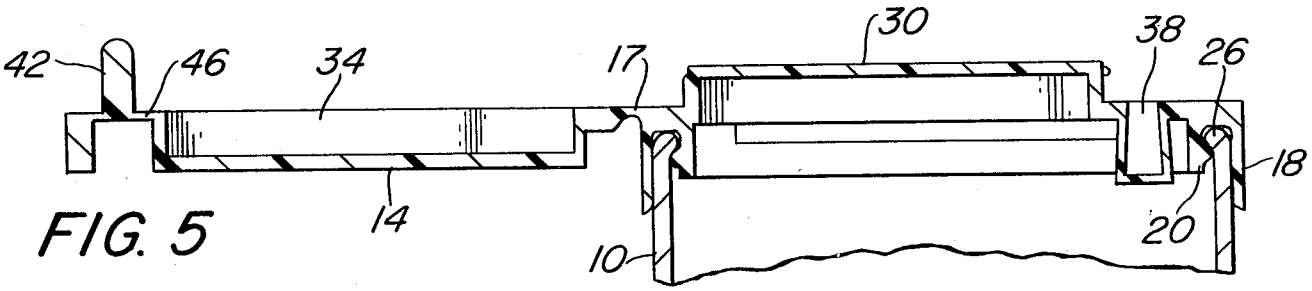
FIG. 5 is a sectional view taken along the line 5—5 in FIG. 2.

Referring to the drawings in detail, wherein like numerals indicate like elements, there is shown a container designated generally as 10. The container has a closure 12 to which is attached covers 14 and 16 by way of a hinges 17, 17' respectively to thereby define a closure assembly 19.

The closure 12 has inner and outer peripheral walls 20 and 18 respectively with a channel 22 therebetween. See FIGS. 3 and 9. The container as shown is a metalic container having a lip 26 on its upper peripheral edge. The upper peripheral edge portion of the container 10 is snapped into the channel 22 with the lip 26 being above the projection 24. The closure assembly 19 is a one piece assembly molded from a polymeric plastic material such as polypropylene. The container 10 may be metal, plastic, glass, etc. The material in the container 10 and to be dispensed may be any one of a wide variety of products in a form of powder, flakes, beads or the like and may be foods, pharmaceuticals, chemicals, etc.

The closure assembly 19 has a base wall 28 with an integral raised portion 30 of generally rectangular shape. Portion 30 has one or more dispensing openings 32 for dispensing the contents of the container 10. The cover 14 is connected to the base wall 28 by hinge 17 and has a shape corresponding to the shape of portion 30. See FIG. 2. Cover 14 has a peripheral rim 34 corresponding to the height of projection 30. Within the rim 34, the cover is provided with a plurality of projections 36 corresponding in number to the number of openings 32. Each projection 36 is adapted to telescope into an close one of the openings 32 in the closed position of the cover 14. Projections 36 are preferably hollow.

While the portion 30 is generally rectangular, it has a narrow end. On opposite sides of the narrow end, there is provided recesses 38 and 40 on the base wall 28. The cover 42 includes a pin 42 adapted to telescope into recess 38 and a pin 44 adapted to telescope into recess 40. Pins 42 and 44 are connected to the cover 14 by a weak zone and indicated by the numeral 46.

The base wall 28 has a second raised portion 48 which is generally rectangular in shape. Raised portion 48 has the same height as portion 30. Portion 48 is substantially larger than portion 30 and has a triangular opening 50 therein. The inner surface of cover 16 has a generally triangular wall 52 which is adapted to telescope into the opening 50 in the closed position of cover 16. Cover 16 has a peripheral rim 54 whose height corresponds to the height portion 48. The base wall 28 is provided with recesses 56 and 58 on opposite sides of a narrowed end of the portion 48. Cover 16 has a pin 60 adapted to telescope into the recess 56 and has a pin 62 on the opposite side which is adapted to telescope into the recess 58. Each of the pins 60 and 62 are connected to the cover 16 by a weak zone defined by numeral 64. See FIG. 4.

Figure 9:
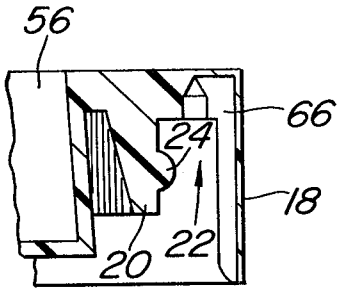
FIG. 9 is a sectional view taken along the line 9—9 in FIG. 8.

Referring to FIGS. 8 and 9, each corner of the closure 12 has an arcuate weak zone designated 66. The weak zone 66 extends along the outer peripheral wall 18 and into the base wall 28.

The hinges 17, 17' enable the covers 14 and 16 to independently move between open and closed positions. Cover 14 facilitates dispensing through the openings 32 by sifting. Cover 16 facilitates access to the contents of container 10 by way of a tea spoon or the like which may extend through the triangular opening 50.

Cover 14 snaps over bead 68 on the raised portion 30 when in a closed position. Cover 16 snaps over bead 70 on the raised portion 48 when in a closed position. When cover 14 is closed, pins 42, 44 are force fit in recesses 38, 40 respectively. When cover 16 is closed, pins 60, 62 are force fit in recesses 56, 58 respectively.

Figure 6:
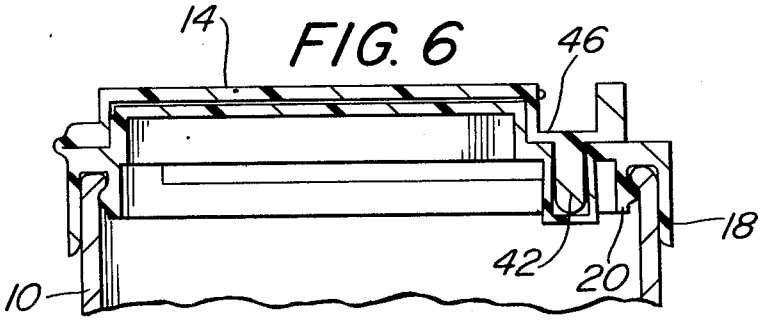
FIG. 6 is a view similar to FIG. 5 but showing the covers in their closed position and the closure mounted on the container.
Figure 7:
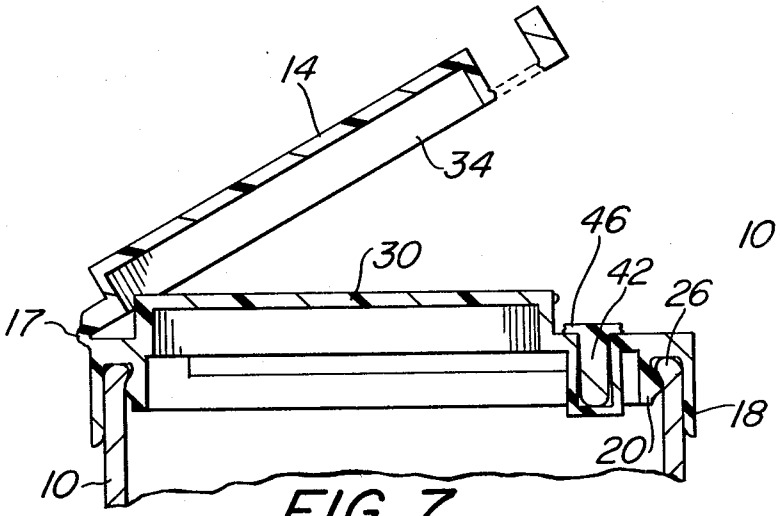
FIG. 7 is a sectional view similar to FIG. 6 but showing the covers in a partially opened position.

A tamper evident means is provided in connection with each of the covers 14 and 16 to indicate that they have been tampered with. The tamper evident means associated with cover 14 constitutes the pins 42, 44 as well as the weak zone 46 in conjunction with the recesses 38, 40 on the base wall 28. In the initial closed position as originally vended by the manufacturer, pin 42 is force-fit into the recess 38. See FIG. 6. When finger pressure is applied, to move the cover 14 from its closed position to its open position, as shown in FIG. 7, the weak zone 46 is severed whereby the pin 42 remains in the recess 38. A similar result exists in connection with pins 44, 62 and 64. Accordingly, if either cover 14 or 16 is moved to an open position, that fact is readily evident.

In the event that someone attempts to tamper with the contents of container 10 by separating the closure 12 from the container 10, the most likely place to cause such separation is at the corners. Due to the weak zones 66 located at the corners, any such attempt will result in severing a corner of the closure 12. Such severing of a corner of the closure 12 will readily constitute evidence of tampering.

The closure assembly 19 is preferably injection molded with the integral hinges 17, 17' so as to be a one-piece closure assembly. While two separate covers are provided in connection with two different dispensing openings, it is within the scope of the present invention to have only a single cover and a single dispensing opening. The one piece construction of the closure assembly 19 facilitates movement of the covers between open and closed positions by pivoting, but other types of movement of the covers between said positions are within the scope of the present invention.

The present invention may be embodied in other specific forms without departing from the spirit or essential attributes thereof and, accordingly, reference should be made to the appended claims, rather than to the foregoing specification, as indicating the scope of the invention.

I claim:

1. A tamper-evident dispensing closure assembly comprising: a closure having a periphery adapted for attachment to the open end of a container, said closure having a wall containing a dispensing opening; a cover movably connected to said closure for movement between a closed position and an open position with respect to said opening; and means on said assembly for evidencing tampering including a pin attached directly to said cover by a weak zone, said pin having a projecting portion at one end and an exposed portion at its opposite end, said projecting portion of said pin engaging a recess in said wall of said closure in a force fit relationship upon moving said cover to its closed position, said weak zone severing as a result of movement of said cover to its open position from said closed position, said projecting portion of said pins remaining engaged in said recess after opening and said exposed portion evidencing tampering.

2. A closure assembly in accordance with claim 1 wherein said cover and closure are made in one piece from a polymeric plastic.

3. A closure assembly in accordance with claim 2 wherein said cover is connected to said closure by an integral hinge for pivotable movement of the cover between open and closed positions.

4. A closure assembly in accordance with claim 1 wherein two discrete covers are associated with said closure, said closure having a discrete opening associated with each cover.

5. A closure assembly in accordance with claim 1 wherein a curved portion of the periphery of said closure is weakened and adapted to sever in the event that an attempt is made to separate the closure from a container.

6. A container having a tamper-evident dispensing closure assembly comprising: a rectangular container having rounded corners and open at one end; a closure attached to said open end of said container and closing said open end of said container, said closure having a wall with at least one opening to facilitate dispensing contents from the container; a cover movably connected to said closure for movement between a closed position and an open position with respect to said opening in said wall; and means for evidencing tampering including a first portion on said cover and a second portion being connected to said cover by a weak zone which is severed as a result of moving said cover to its open position, said closure having rounded corners and at least some of the rounded corners on said closure having a weak zone which is severed as a result of an attempt to separate the closure from the container.

7. A container in accordance with claim 6 wherein said tamper indicating means includes a pair of projections each connected to said cover by said weak zone and a mating pair of recesses in said closure.

8. A container in accordance with claim 7 wherein the cover is generally rectangular with a narrowed neck portion on a free end thereof, said projections being on opposite sides of said narrowed neck portion.

9. A container in accordance with claim 6 where said cover has an integral projection which enters said opening in the closed position of the cover.

* * * * *